United States Patent [19]

Kawashima et al.

[11] Patent Number: 4,859,098

[45] Date of Patent: Aug. 22, 1989

[54] PAPER FEEDER FOR A PRINTER

[76] Inventors: Norio Kawashima, 17-17 Hirado 2 chome, Totsuka-ku, Yokohama-shi, Kanagawa-ken; Hidemi Haga, Mori-so, 19-9 Nakahama-cho, Isogo-ku, Yokohama-shi, Kanagawa-ken, both of Japan

[21] Appl. No.: 170,686

[22] Filed: Mar. 17, 1988

Related U.S. Application Data

[63] Continuation of Ser. No. 915,154, Oct. 2, 1986, abandoned.

[30] Foreign Application Priority Data

Oct. 3, 1985 [JP] Japan ..... 60-220967

[51] Int. Cl.[4] ..... B41J 11/26; B41J 13/16

[52] U.S. Cl. ..... 400/616; 400/605; 400/647

[58] Field of Search ..... 400/578, 611, 612, 616.1, 400/616.2, 616.3, 616, 622, 642, 605, 647, 647.1, 636.2

[56] References Cited

U.S. PATENT DOCUMENTS

| | | | |
|---|---|---|---|
| 1,180,250 | 4/1916 | Dennis | 400/636.2 X |
| 4,475,833 | 10/1984 | Sawicki | 400/605 |
| 4,571,103 | 2/1986 | Takeo et al. | 400/616.2 |

FOREIGN PATENT DOCUMENTS

| | | | |
|---|---|---|---|
| 112778 | 7/1983 | Japan | 400/616.1 |
| 0112778 | 7/1983 | Japan | 400/616.1 |
| 0187881 | 10/1984 | Japan | 400/647 |
| 187881 | 10/1984 | Japan | 400/647 |

OTHER PUBLICATIONS

I. B. M. Technical Disclosure Bulletin, vol. 23, No. 7B, Dec. 1980, pp. 3109-3110 "Cut-Forms Guide", M. F. Davis et al.

*Primary Examiner*—Charles Pearson

*Attorney, Agent, or Firm*—Albert L. Jeffers; Anthony Niewyk

[57] ABSTRACT

A paper feeder for a printer which is adapted for feeding both continuous printing paper and cut sheet printing paper. A second frame which may carry the platen supports the rear end of a first frame which in turn supports the tractor feeder in such a manner that the first frame can be rotated backward from a first position adapted for feeding continuous paper to a second position adapted for making a room for mounting a paper guide to the printer. If the tractor feeder is adapted for pushing continuous paper towards the platen, continuous paper can be kept on the tractor feeder even when the second frame is at its second position.

2 Claims, 3 Drawing Sheets

PAPER FEEDER FOR A PRINTER

This is a continuation of application Ser. No. 915,154, filed Oct. 2, 1986, now abandoned.

TECHNICAL FIELD

The present invention relates to a paper feeder for a printer and in particular to a paper feeder which is adapted for feeding both continuous printing paper and cut sheet printing paper without actually replacing the paper feeder.

BACKGROUND OF THE INVENTION

A conventional printer such as a dot matrix impact printer, a dot matrix thermal printer, a daisy printer or the like is typically provided with an arrangement for feeding printing paper. The printing may be either cut sheet paper or continuous paper depending on the particular application of the printer, and the paper feeding means must be arranged accordingly. Cut sheet paper is typically frictionally fed through a nip between a platen and a roller while continuous paper is typically fed by a tractor feeder.

If the two kinds of printing paper are to be used on a same printer, it has been necessary to replace the paper feeder. For instance, when continuous printing paper is to be used, then the tractor feeder must be removed to make room for a paper guide member such as a paper tray. Conversely, when cut sheet printing paper is to be used, then the tractor feeder must be installed while the paper guide member must be removed. In particular because a tractor feeder is a complicated device and some care is necessary for installing it, it has been felt as extremely cumbersome and disrupting that the paper feeder must be replaced every time the printing paper is changed from one form to another.

BRIEF SUMMARY OF THE INVENTION

In view of such inconveniences of the prior art, a primary object of the present invention is to provide a paper feeder for a printer which can be readily adapted for either one of cut sheet printing paper and continuous printing paper as required.

According to the present invention, such an object is accomplished by providing a paper feeder for a printer having a platen, a tractor feeder and a first frame supporting the tractor feeder, comprising: a means for mounting a paper guide member for guiding out sheet paper; a second frame which supports the rear end of the first frame in such a manner that the first frame can be rotated backward from a first position adapted for feeding continuous paper to a second position adapted for making a room for mounting the paper guide to the printer.

Thus, simply by changing the position of the paper feeder, the mode of paper feeding can be readily changed. in particular, the printer housing proposed by patent application No. 915,155 filed by Osamu Tano, et al on the same day as this application can be advantageously applied to the present invention.

According to a certain aspect of the present invention, the tractor feeder is adapted for pushing continuous paper towards the platen in such a manner that when the second frame is at its second position continuous paper can be kept on the tractor feeder.

BRIEF DESCRIPTION OF THE DRAWINGS

The present invention will now be shown and described in the following in terms of a concrete embodiment thereof with reference to the appended drawings, in which.

DETAILED DESCRIPTION OF THE PREFERRED EMBODIMENT

Figure 1:
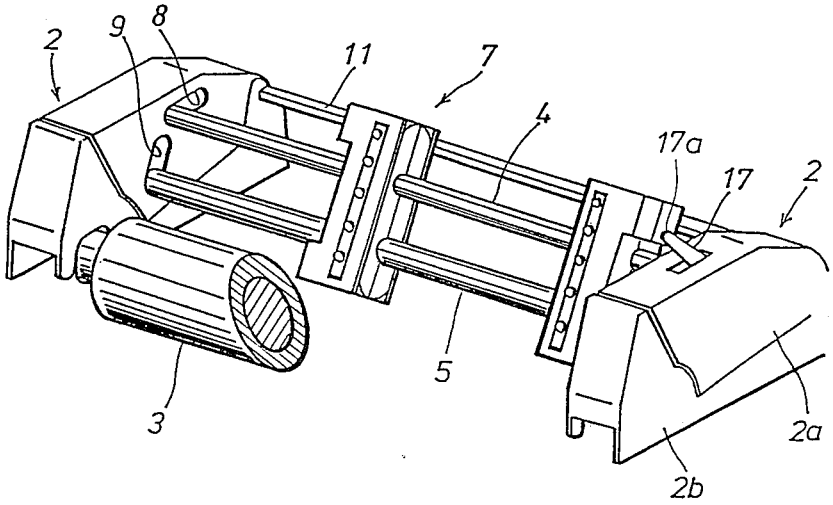
FIG. 1 is a partly broken away perspective view of an embodiment of the paper feeder of the present invention.

As shown in FIG. 1, a columnar platen 3 and a pair of lateral shafts 4 and 5 extend between a pair of frames 2 provided on either side end of the printer. A pair of tractor feeder units 7 are fitted over the lateral shafts 4 and 5 so as to be adjustable of their positions along the lateral shafts 4 and 5. The rear parts of the frames 2 are connected by a pivot shaft 11.

Figure 6:
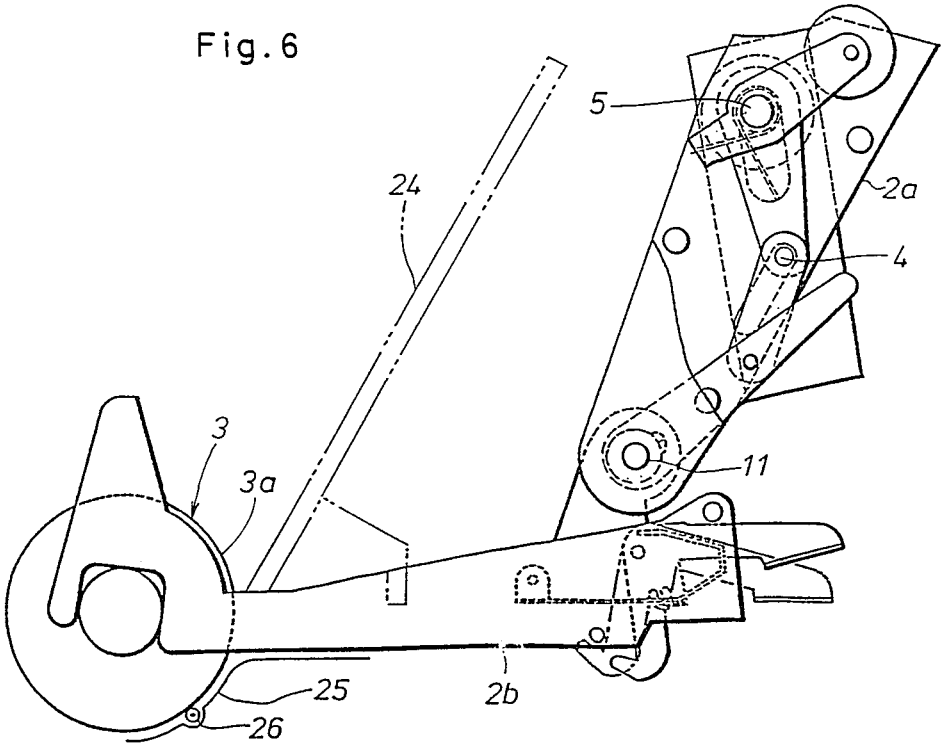
FIGS. 3 to 6 are simplified schematic side views of the paper feeder when it is adapted for different modes of paper feeding.
Figure 2:
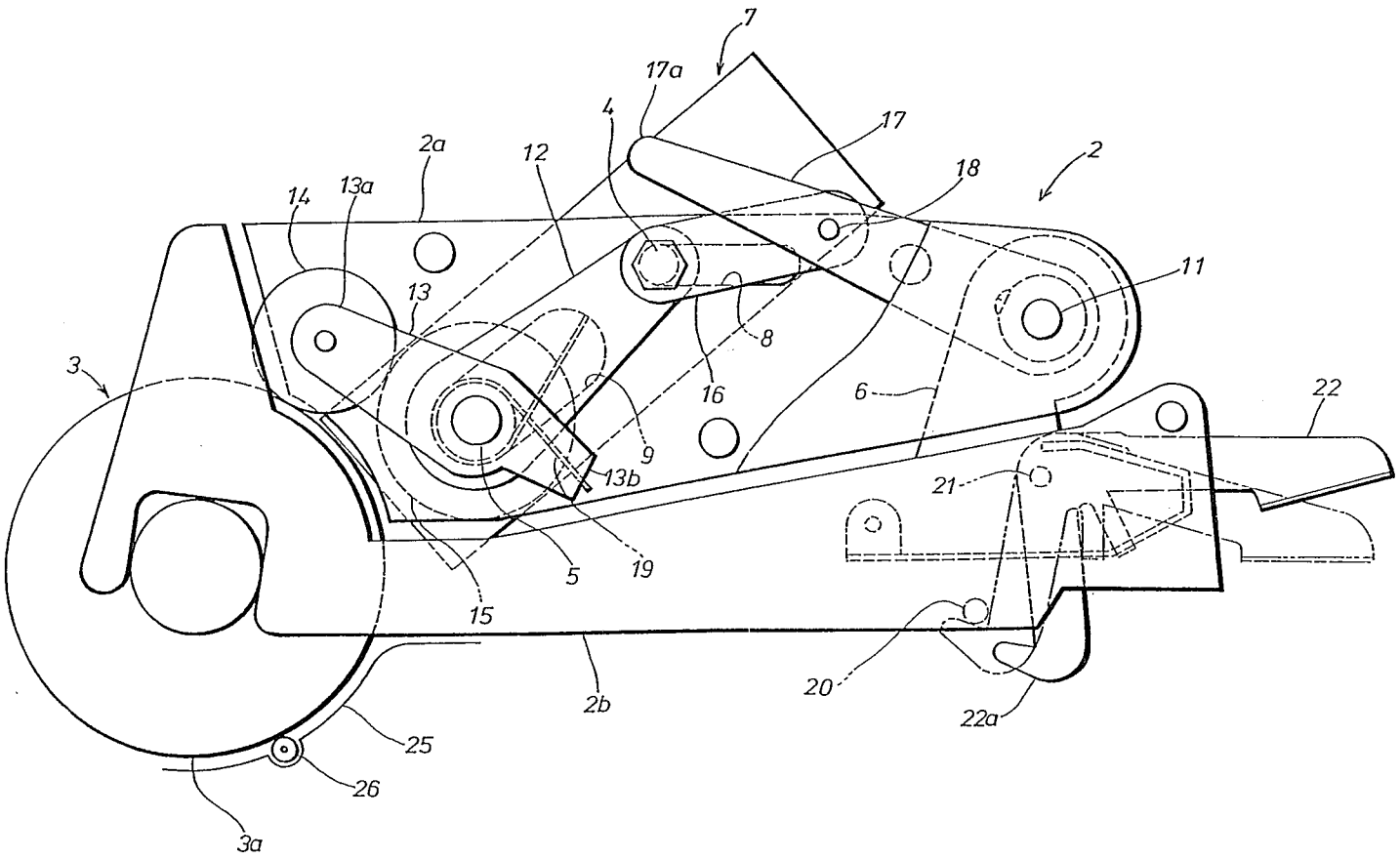
FIG. 2 is a schematic side view of the paper feeder of FIG. 1 illustrating the mechanism thereof in greater detail.

As best shown in FIG. 2, each of the frames 2 consists of an upper frame 2*a* and a lower frame 2*b*, and the upper frames 2*a* are pivoted, at their rear ends, to the lower frames 2*b* by way of a pair of brackets 6 which project from the rear ends of the lower frames 2*b* and the pivot shaft 11 passed therethrough, so as to be backwardly rotatable as shown in FIG. 6 about the pivot shaft 11.

The internal structures of the frames 2 are identical to each other except for certain slight differences. Therefore, in the following description, only one of the two frames 2 is described and the slight differences are described hereinafter.

The ends of the lateral shafts 4 and 5 are received in a slot 8 which is substantially horizontal and another slot 9 which is inclined upwards towards the rear, respectively, and both of the slots 8 and 9 are formed in the side plate of the upper frame 2*a*. The end of the lateral shaft 4 received in the frame 2*a* is fixedly attached to a connecting plate 12, and the other end of the connecting plate 12 rotatably supports the end of the other lateral shaft 5 received in the frame 2*a*. The same end of the lateral shaft 5 is rotatably supported by an intermediate part of a link 13. One end 13*a* of the link 13 rotatably supports a spur gear 14 while the other end 13*b* of the link 13 is engaged to an end of a torsion coil spring 19 which biases the link 13 in counter clockwise direction in the sense of FIG. 2.

The gear 14 is meshed with a gear 15 fixedly attached to the end of the lateral shaft 5 received in the frame 2*a* as well as with gear 3*a* which is fixedly attached to an end of the platen 3. Thus, when the platen 3 is rotatively driven by a drive means which is not shown in the drawings, the torque thereof is transmitted to the lateral shaft 5 by way of the gears 3*a*, 14 and 15 and drives a pair of pulleys and tractor pin belts passed around the pulleys (which are not shown in the drawings) for effecting the feeding of printing paper by engagement of the pins of the tractor pin belts with the perforations provided in the lateral edges of the printing paper. In this case, the pins of the tractor pin belts projects from both the upper and the lower surfaces of the tractor feeder units.

The end of the lateral shaft 4 received in the frame 2a is pivotably connected to a link 16 and the other end of the link 16 is connected, by way of a pin 18, to an intermediate point of an arm 17 which is pivotably supported by the pivot shaft 11. The free end 17a of the arm 17 projects out from a slot provided in the upper surface of one of the frames 2a, but the arm 17 in the other frame 2a lacks such a free end as shown in FIG. 1 and the arm 17 of the other frame extend only between the pin 18 and the pivot shaft 11.

Thus, in the other frame 2, the corresponding ends of the lateral shafts 4 and 5 are simply received in slots which are identical to the slots 8 and 9 and are mutually connected by a connecting plate which is identical to the connecting plate 12. Thus, these ends of the lateral shafts 4 and 5 received in this frame 2 follow the motion of the other ends of the lateral shafts 4 and 5 received in the other frame 2.

A lever 22 is pivoted to the rear part of the lower frame 2b, and the frame 2 can be removed from the main body of the printer by disengaging an engagement portion 22a provided on one end of the lever 22 from an engagement pin 20 provided on the side of the printer main body 30. The lower circumferential surface of the platen 3 is in contact with a roller 26 which is rotatably supported by a shaft which is parallel to the platen 3 and a paper guide 25 consisting of an arcuately curved plate is provided adjacent thereto.

The operation of the present embodiment is described in the following with reference to FIGS. 3 to 6.

Figure 3:
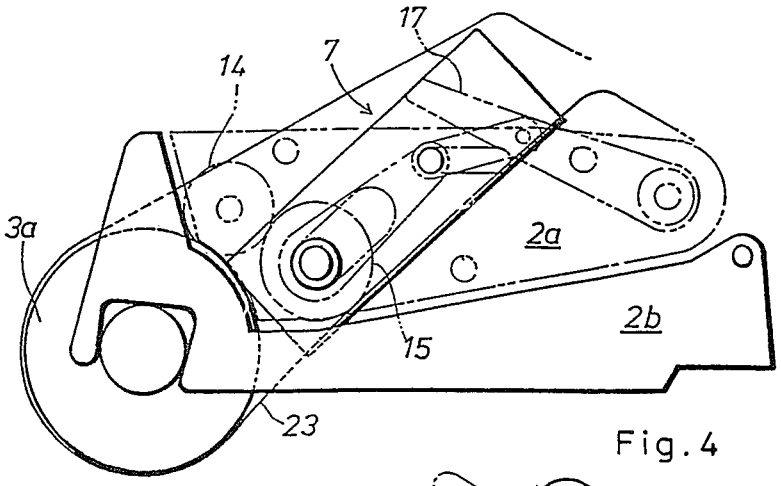

In the state shown in FIG. 3 which is identical to FIG. 2 except that FIG. 3 is more simplified than FIG. 2, the lower surfaces of the tractor feeder units 7 are aligned with a tangential direction of a lower part of the platen 3 and the printing paper 23 is pushed by the lower surfaces of the tractor feeder units 7 towards the platen 3 which is also driven by a drive means which is not shown in the drawings.

Figure 4:
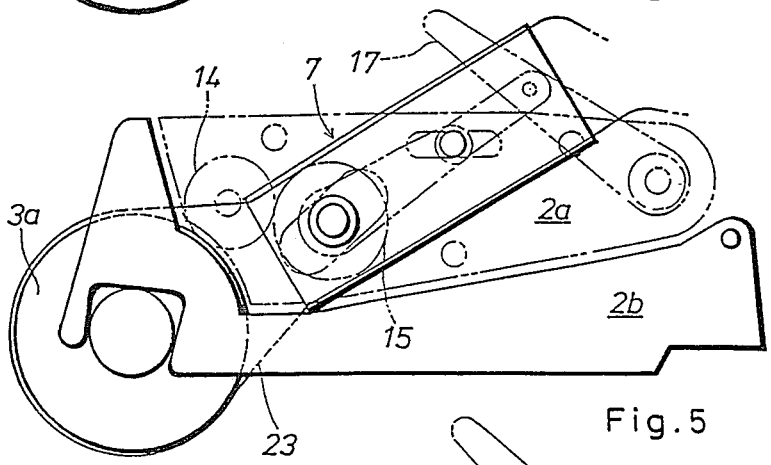
Figure 5:
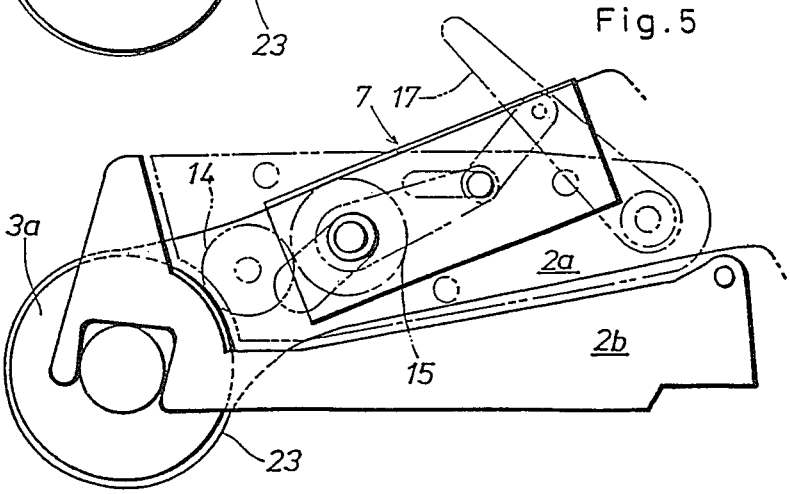

When the free end of the arm 17 projecting from the upper part of the upper frame 2a is pulled up into the position shown in FIG. 4, the lateral shaft 4 moves in th slots 8 toward the rear while the lateral shaft 5 moves in the upward and rearward direction guided by the inclinded slots 9, and the tractor feeder units 7 themselves aligned with a radial line of the platen 3. In this state, the perforations of the printing paper 23 are engaged to the pins of the upper and the lower surfaces of the tractor feeder units 7, and the printing paper is both pulled and pushed by the tractor feeder units 7 away from and towards the platen 3. Thus, the printing paper is positively driven in both directions by the tractor feeder units 7 and passed around the platen 3.

When the arm 17 is further pulled up into the position shown in FIG. 6, the upper surfaces of the tractor feeder units 7 align with a tangential direction of an upper part of the platen 3 and only the pins projecting from the upper surfaces of the tractor feeder units 7 engage with the perforations of the printing paper 23. Therefore, the printing paper 23 which has passed around the surface of the platen 3 is pulled away from the platen 3 by the tractor feeder units 7.

The arm 17 can be retained at the three positions by a detent mechanism which is not shown in the drawings.

FIG. 6 shows the state of the paper feeder of the present embodiment when cut sheet printing paper is to be handled. In this case, the upper frame 2a is thrown backward about the pivot shaft 11 and a paper tray 24 is placed along a tangential direction of the platen as required. Therefore, when a sheet of cut sheet paper is placed on the paper tray 24, the lower edge of the paper passes through the nip between the platen 3 and the roller 26 and is passed around the platen 3 in a usual manner. In this case, since the tractor feeder units 7 and the upper frame 2a are rotated backward well out of way for handling cut sheet printing paper, there is no need to actually remove the tractor feeder units 7. When only the lower surfaces of the tractor feeder units 7 are used or when the tractor feeder is adapted for pushing continuous paper towards the platen, the continuous paper may be kept on the tractor feeder units 7 while cut sheet printing paper is being used for printing.

What we claim is:

1. A paper feeder for a printer, said paper feeder comprising a rotatable platen, a roller defining a nip between said platen and roller, a tractor feeder, a first frame supporting the tractor feeder, a second frame attached to said platen, and a detachable paper guide member for feeding cut paper to the platen and including a planar member supported on said second frame, said planar member defining an acute angle between a first surface of said planar member and a horizontal plane, said planar member oriented tangentially to said platen, whereby said detachable paper guide member guides cut sheet paper directly into said nip;

said second frame rotatably supporting a first end of the first frame whereby the first frame and tractor feeder are rotatable from a first operative position wherein said tractor feeds continuous paper around the platen to a second inoperative position and thereby permitting the paper guide member to be supported by the printer.

2. A paper feeder as defined in claim 1, wherein the tractor feeder includes means for pushing continuous paper towards the platen in said first operative position and said first frame rotates substantially away from said platen in said second inoperative position whereby, when the second frame is at its second inoperative position, continuous paper can remain mounted on the tractor feeder.

* * * * *